US005203357A

United States Patent [19]

Vigliotti

[11] Patent Number: 5,203,357

[45] Date of Patent: Apr. 20, 1993

[54] PERMING METHOD AND DEVICE

[76] Inventor: James A. Vigliotti, 273 Morris St., Stirling, N.J. 07980

[21] Appl. No.: 770,880

[22] Filed: Oct. 4, 1991

[51] Int. Cl.[5] ..... A45D 7/00

[52] U.S. Cl. ..... 132/210; 132/270; 132/272; 34/99

[58] Field of Search ..... 132/204, 205, 207, 210, 132/226, 227, 228, 270, 271, 272; 34/96, 97, 98, 99, 100

[56] References Cited

U.S. PATENT DOCUMENTS

| | | | |
|---|---|---|---|
| 2,264,814 | 12/1941 | Stanley | 132/212 |
| 2,416,788 | 3/1947 | Andrews | 34/99 |
| 2,503,113 | 4/1950 | Hribar | 34/99 |
| 3,182,666 | 5/1965 | Watkins | 132/212 |
| 3,444,624 | 5/1969 | Greenlee | 132/271 |
| 4,112,591 | 9/1978 | Marsh | 34/99 |
| 4,905,716 | 3/1990 | Hubbard | 132/270 |

FOREIGN PATENT DOCUMENTS 8502997 7/1985 PCT Int'l Appl. ..... 34/100

*Primary Examiner*—Gene Mancene
*Assistant Examiner*—Frank A. LaViola
*Attorney, Agent, or Firm*—William T. Hough

[57] ABSTRACT

A method and device facilitating the optimal degree of processing of hair during permanent waving (perming) of hair. As a critical part of a combination of otherwise conventional sequential perming steps, the inventive method vacuums moisture from rod-mounted hair following the water rising of waving lotion from the perm processed hair. The vacuuming device includes a cover worn on the head substantially sealed around the mounting periphery thereof, with the cover forming free-space above and around the rod mounted hair and with the cover having channel structure channeling outer ambient room temperature air toward hair roots of rod-mounted hair.

20 Claims, 1 Drawing Sheet

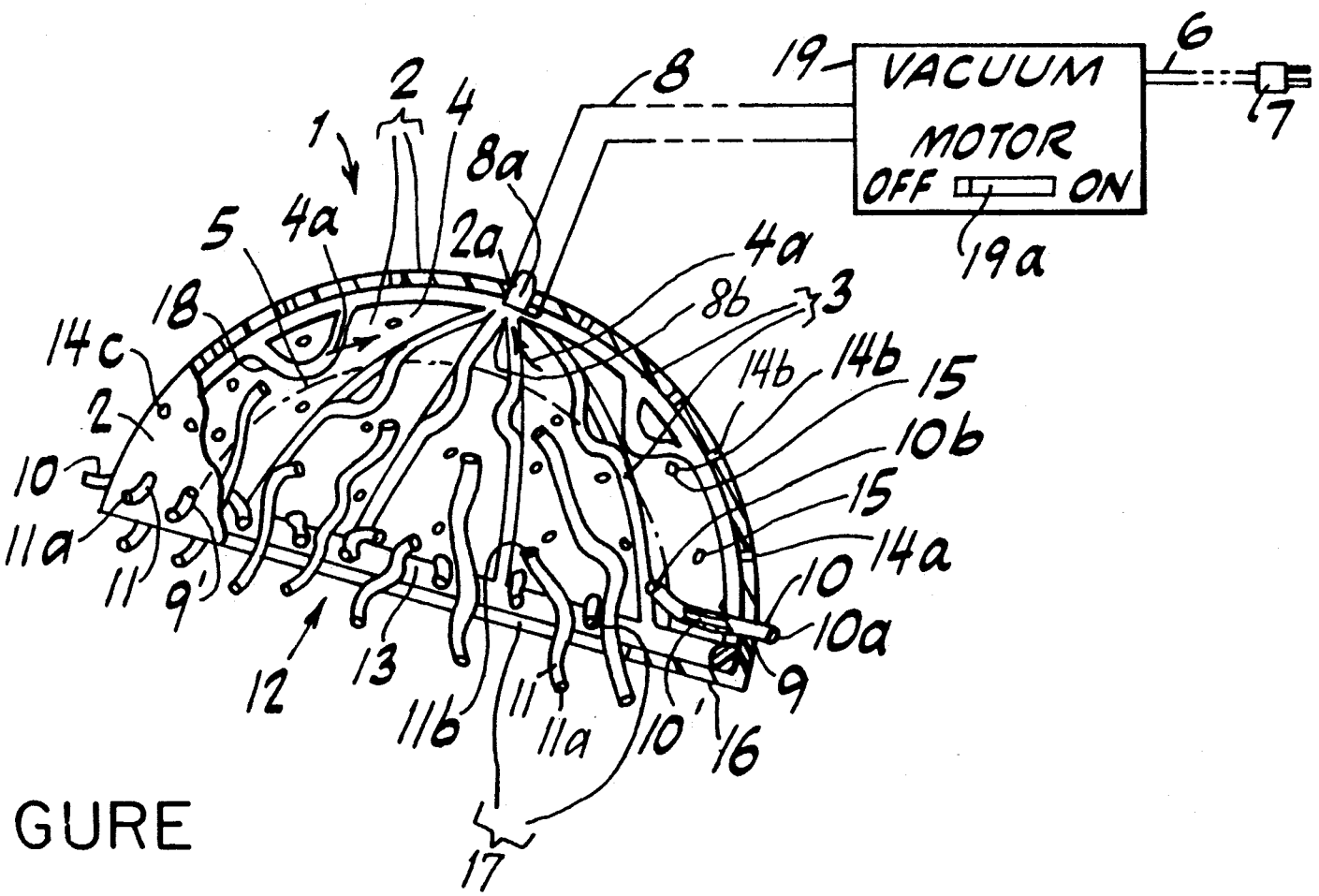
FIGURE

PERMING METHOD AND DEVICE

This invention relates to an improved method and device for perming rod-mounted hair.

PRIOR ART

While no relevant patents were located during a patentability search in United States class 34, subclasses 92, 96, 97 and 99, patents of interest are as follow. U.S. Pat. No. 4,486,961 issued Dec. 11, 1984 to Wendela, U.S. Pat. No. 2,081,034 issued Jan. 7, 1935 to Carter, U.S. Pat. No. 2,221,822 issued Nov. 19, 1940 to Tays, U.S. Pat. No. 4,118,874 on Jan. 10, 1978 to Morane, U.S. Pat. No. 3,782,002 on Jan. 1, 1974 to Morane and U.S. Pat. No. 4,692,594 on Sep. 8, 1987 to Martin Patent each and all heat hair to dry the hair. Martin after blowing heated air onto the hair, sucks air from a collapsed-space through one curler per curl. U.S. Pat. No. 3,444,624 issued on May 20, 1969 to Greenlee is an especially-designed concave cover placed against an upper face of hair mounted curler, and air is sucked through the concave member to facilitate drying washed hair after mounting on the curlers. Tays patent expels hot air through outlet vents 16. No patents relate to perms nor to the processing during a perm prior to adding a neutralizing solution, thus having no bearing on the present invention.

BACKGROUND TO THE INVENTION

In the conventional perming of rod mounted hair, the structure of the hair is chemically changed by temporarily breaking hair chemical bonds between hydrogen and sulfur, in the cortical layer of the hair allowing the hair to assume the shaped conforming to its state on the mounted rods. From the moment of applying activated waving lotion (or the like) to the hair mounted on the rods, chemical processing begins. If processing continues to too great a degree, i.e. if there is too much processing resulting in too many bends broken, the hair can be damaged or destroyed. The reestablishment of correctly processed hair is achieved by water-rinsing the hair followed by applying a neutralizing liquid solution or the like after the rinsed hair has been properly dried by toweling. It has been proper procedure to towel dry the hair prior to applying the neutralizing lotion. A typical commercially available towel is Marcal PS Towels (TM) produced by Marcal Paper Mills, Inc. Conventional waving, processing and neutralizing lotions are Matrix (TM) of Essentials, Inc. of Solon, Ohio, and Image (®) of Image Laboratories of Las Angeles, Calif.

OBJECTS

Accordingly, objects of the present invention include the invention of a novel perm method and device utilized in the method, to secure more reliable and speedy safe and even removal throughout rod-mounted hair so as to achieve even moisture removal on the surface and interior portions of rod-mounted hair and from about the base of the hair adjacent the roots (hair follicles) immediately following the water rinsing of residual waving lotion from the rod mounted hair.

Another object is to obtain improved predictability and uniformity of degree of processing in drying of rod-mounted hair after rinsing waving solution therefrom, prior to treating the rinsed hair with neutralizing lotions or the like.

Other objects become apparent from the foregoing and following disclosure.

THE BROAD INVENTION

The inventor observed the discomfort of persons during heretofore essential "toweling" of the rinsed hair water-rinsed after processing of rod mounted hair by the previously-applied waving lotion. The inventor also observed variations in extent of processing coming to exist with uneven toweling and/or toweling at different rates and times. Also the inventor observed that major differences in rate of degree of continued processing before neutralizing residual waving lotion even after rinsing, as reflections of how much moisture continued to exist and for how long, and differences in residual moisture content in hair adjacent the hair follicles or roots and the warmer temperature near the scalp accelerating processing. The inventor likewise recognized that cool rinse water predominantly reaching the middle and distal ends of the hair during rinsing and cool air drying slowed the continuing processing rate and that hot water rinse and/or hot air drying accelerated and/or fostered continued processing of the hair by residual waving lotion and/or prior to neutralization to reestablish the hydrogen-sulphur bonds accordingly quick, evenly distributed, thorough and complete removal of major moisture at cool removal temperature fostered the present invention to achieve quick, cool and even moisture removal substantially equally near the scalp and at distal hair portion, by the inventive method and device as follows, making predictable and even processing. Accordingly, the invention may be broadly described as a an improved method of perming hair, and a novel device by which the method of the invention may be optimally practiced, for the novel step of vacuuming moisture from the dampened hair following the rinsing of perm lotion therefrom.

In the broad embodiment, the improved perming method includes several sequential steps, as an overall combination. The first step involves the applying of water to hair to be permed, in an amount sufficient to obtain dampening of the hair, a conventional step. Thereafter is the step of conventional wrapping the dampend hair on perm rods, such rods being conventional in nature and well known in the trade. Thereafter there is the conventional applying of perm solution to the hair. Thereafter there is the conventional step of water-rinsing residual perm solution from the perm-solution treated hair to obtain rinsed hair—such rinsed hair being substantially free of most of residual perm lotion that has not reacted with or clung to the hair. Thereafter comes the novel step of the combination, namely the vacuuming of moisture from the rinsed hair—whereby residual moisture is safely removed devoid of dangers of over-processing from residual perm motion and devoid of uneven moisture removal, together with being devoid of discomfort and time consuming conventional toweling which normally is uncomfortable and undesirable to the person receiving the toweling previously typically practiced. Thereafter, after the vacuum removal of moisture, is the conventional step of applying a neutralizing water-solution perm-neutralizer to the hair. Thereafter, after the vacuum removal of moisture, is the conventional step of applying sufficient rinsing water to the hair to rinse residual water-solution perm-neutralizer from the hair in its neutralized state. Thereafter remove residual rinsing water from the rinsed hair. Taking-down of the set hair from the perm rods may be either before or after this moisture removal.

In a first preferred method embodiment as to the broad inventive method combination above-stated, after said rinsing, said vacuuming includes substantially enclosing space surrounding said rinsed hair followed by thereafter applying vacuuming to enclosed space substantially surrounding said perm rod-mounted hair to applying said neutralizing solution.

In a second preferred method embodiment as an improvement on the first preferred method embodiment, the vacuuming of the hair includes channeling of the set hair from the perm-rods, consists essentially of vacuuming of moisture therefrom.

In a third preferred method embodiment as an improvement on the sixth preferred method embodiment, there is included a vacuuming of moisture from the set hair after rinsing-away risidual neutralizing solution prior to taking-down of the hair from the perm rods.

In an fourth preferred method embodiment as an improvement on the seventh preferred method embodiment, the applying of water to hair to be permed includes shampooing the hair.

In a fifth preferred method embodiment as an improvement on the eighth embodiment, the vacuuming of the hair includes channeling of flow of ambient room-temperature air to scalp-located ends of the hair. As a result thereof, channelled air is drawn through wet or moist hair mounted on perm rods. Thereby rapid removal of water or moisture by the vacuuming is enhanced and facilitated.

In a sixth preferred method embodiment as an improvement on the above-described broadest method of the method invention, the vacuuming of the hair includes channeling of predetermined restricted flow of the ambient room-temperature air to the enclosed space to the enclosed space relative to larger volume of flow channelled to the scalp-located ends of the hair.

In an seventh preferred method embodiment as an improvement on the above-described broadest method of the method invention, the vacuuming of the hair includes includes separately channeling the ambient room-temperature air concurrently to a plurality of spaced-apart locations.

In a eighth preferred method embodiment as an improvement on the above-described broadest method of the method invention, the vacuuming of the hair includes, when being for greater channeling distances to some of the plurality, the channeling at the greater distances being channeled at greater volume of air-flow. As a result thereof, volume of channeled air reaching more distant ones of the plurality is substantially equal to volume of air reaching less distant ones of the plurality. Thereby channeled air reaching all of the plurality is substantially constant in volume.

In a ninth preferred method embodiment as an improvement on the above-described broadest method of the method invention, the removal of rinsing water prior to taking down the set hair from the perm-rods, consists essentially of vacuuming of moisture therefrom, excluding any other steps inconsistent with vacuuming with typically ambient temperature, thereby avoiding temperature that would cause over-processing by excessive heat and/or uneven drying of different portions of the hair.

In a tenth preferred method embodiment as an improvement on the above-described broadest method of the method invention, there is included a vacuuming of moisture from the set hair following taking-down of the hair from the perm rods.

In a eleventh preferred method embodiment as an improvement on the broad embodiment of the method previously described, the applying of water to the hair to be permed includes shampooing the hair.

In a broad embodiment of the above-noted device of this invention, the perm-setting device consists essentially of a first vacuuming structure and mechanism therefor, for substantially enclosing space surrounding said rinsed hair rinsed from residual perm solution and for applying vacuuming to enclosed space substantially surrounding said perm rod-mounted hair.

In a twelfth preferred embodiment as improvement on the broad perm-setting device embodiment, there is included a second vacuuming structure and mechanism thereof for channeling of predetermined restricted flow of said ambient room-temperature air to said enclosed space to said enclosed space relative to larger volume of flow channelled to said scalp-located ends of said hair.

In a thirteenth preferred embodiment as an improvement on the sixteenth preferred device embodiment, there is included a third vacuuming structure and mechanism therefor, for separtely channeling ambient room-temperature air concurrently to a plurality of spaced-apart location.

In an fourthteenth preferred embodiment as an improvement on the seventeenth preferred embodiment, there is included a fourth vacuuming structure and mechanism therefor, for channeling ambient room-temperature air for greater distances to some of said plurality, said channeling at said greater distances providing for greater volume flow such that volume of channeled air reaching more distant ones of said plurality is substantially equal to volume of air reaching less distant ones of said plurality whereby channeled air reaching all of said plurality is substantially constant in volume.

In a fifteenth preferred device embodiment as an improvement on the broad device embodiment above-described, there is included a second vacuuming structure and mechanism therefor, for separately channeling ambient room-temperature air concurrently to a plurality of spaced-apart locations.

In a sixteenth preferred embodiment as an improvement on the nineteenth preferred embodiment, there is included a third vacuuming structure and mechanism therefor, for channeling ambient room-temperature air for greater distances to some of said plurality as compared to remaining others of said plurality, said channeling at said greater distances providing for greater volume flow such that volume of channeled air reaching more distant ones of said plurality is substantially equal to volume of air reaching less distant ones of said plurality whereby channeled air reaching all of said plurality is substantially constant in volume.

In a seventeenth preferred device embodiment, the device invention consists essentially of (excluding heat-producing devices) at-least the following elements:

a) an enclosure structure of a shape and size to substantially enclosed an upper hair-portion of the top of a person's head and for providing enclosed free-space above and surrounding perm rod-mounted hair of a person when mounted on the person's head;

b) a enclosure support structure providing support of the enclosure structure sufficiently to maintain the free-space when the enclosure structure is worn on the person's head; and c) vacuuming structure(s) and mechanism(s) thereof for establishing and maintaining at-least a partial vacuum within the free-space when the enclosure structure is mounted on a person's head.

In a eighteenth preferred device embodiment as an improvement on the twenty-first preferred device embodiment, there is included air-channelling structure(s) and mechanism(s) thereof for channeling ambient-temperature air to the free-space.

In a nineteenth preferred device embodiment as an improvement on the twenty-second preferred device embodiment, the air-channelling structure(s) and mechanism(s) thereof include small apertures of predetermined sizes sufficiently small as to maintain at-least a partial vacuum within the free-space when the enclosure structure is mounted on a person's head.

In a twentieth preferred device embodiment as an improvement on the twenty-second preferred device embodiment, the air-channelling structure(s) and mechanism(s) thereof include tubular structures having opposite open ends in communication with flow space within the tubular structures, at-least some of the tubular structures being of sufficient length as to have one one end positioned adjacent hair follicles of perm rod-mounted hair while a remaining other open end is positioned to receive ambient temperature air exterior to the free-space, and at-least some of remaining ones of the tubular structures being of lengths adapted for receiving and channeling ambient temperature air to the free-space from air-containing space exterior to the free-space.

In an twenty-first preferred device embodiment as an improvement on the twenty-fourth preferred device embodiment, each of the tubular structures have cross-sectional areas of said flow spaces thereof, some of the tubular structures having cross-sectional area of flow spaces extending along a length of the flow space of a magnitude greater than cross-sectional area of flow spaces of the remaining ones of the tubular structures. As a result thereof, exiting quantities of air drawn into the free-space from the longer structures of larger cross-sectional flow space and the remaining tubular structures of lesser cross-sectional area of their flow space, are substantially equal in volume per tubular structure for all of the tubular structures.

In a broad embodiment of the above-noted device of this invention, the perm-setting device consists essentially of a first vacuuming structure and mechanism therefor, for substantially enclosing space surrounding said rinsed hair rinsed from residual perm solution and for applying vacuuming to enclosed space substantially surrounding said perm rod-mounted hair.

In a twenty-second preferred embodiment as an improvement on the broad invention device embodiment, the first vacuuming structure and mechanism therefor includes a substantially hemispherically-shaped dome structure and mechanism therefor, for substantially sealing and maintaining the free-space, and additionally includes at-least one spacer-structure mounted on and extending downwardly and radially-inwardly to at-least one position at which support contact will be made with the head or perm rod-mounted hair whereby maintaining the free-space is facilitated.

The invention may be better understood by making reference to the following FIGURE.

THE FIGURE

The FIG. 1 diagrammatically illustrates the novel vacuuming device of the present invention in a side in-part cross-sectional view, in which the novel method may be practiced.

DETAILED DESCRIPTION

The FIGURE illustrates the cap-shaped novel device 1 with the lower radially-inwardly extending flange 16 with an elastic circumscribing inner boarder-band 17 sealing free-space 4 above the wearer's head 5 (shown in phantom) below the typically soft plastic cover 2 supported by the inwardly and downwardly-extending spacer-members 18 extending inwardly from lower surfaces of the upwardly and radially-inwardly extending rigid-plastic support ribs 3. A through-space hole **2*a* (continuous with free-space 4) has sealedly mounted therein a tube 8 having vacuuming tube through-channel space 8*a* (continuous with free-space 4) in operational and functional connection of the tube 8 with a typically conventionally known vacuuming pump and electric motor thereof cummulatively designated vacuum motor 19 having off-on switch 19*a* with a operatively and functionally connected power-source electrical wire 6 having electrical plug 7. While there are at-least one and typically a plurality of through-space small apertures 14*a*, 14*b* and 14*c* extending from outer ambient room-temperature air to the free-space 4, there are other peripherally-located through-space apertures 9 also connecting the outer ambient air to the free-space 4, having mounted therein short elongated tubes 10 having through-space passages 10' extending between the tube air intake ports (ends) 10*a* and the air outlet ports 10*b*. Additionally other through-space apertures 9' have mounted therein much longer or lengthy tubes 11 which are sufficiently long as to reach distantly located inner-positioned rod-mounted hair and/or positions adjacent hair follicles thereof at scalp-level, such that room ambient air may enter the inlet-ports 11*a* and exit the outlet ports 11*b*. The cross-sections of the entire flow-spaces and inlet ports and outlet ports of the tubes 11 are to varying degrees larger than the cross-sections of the flow spaces and inlet and outlet ports of the tubes 10; the long the tube, the larger the cross-sections above-noted. The head (scalp) above-noted as head 5 (shown in phantom) is positioned within the mounting opening 12 defined by above-noted circumscribing elastic border-band 17. The ribs 3 are anchored on circumscribing bottom rigid plastic rim 13. It is preferred that the cover 2 and the support rim 13 and the ribs 3 be plastic in order to avoid excessive weight when mounted on the head 5 of the person receiving the perm. The above-described small apertures 14*a*, etc., have inner tubular-space outlet ports 15 in inlet-air communication with the above-noted free-space 4. Accordingly, by free-space 4 being maintained by the spacer-members 18 when the device 1 is worn, ambient air drawn through from the inlet ports 15 and tube-end outlet ports 10*b* and 11*b*, together with moisture evaporated from perm rod-mounted hair and from scalp area near the head 5, all travel in directions 41 toward the outlet-port space 8*a* by virtue of vacuum created by the vacuum motor (and pump) 19**.

Accordingly, while the method as a novel combination for perming hair including the mounting thereof on perm rods to obtain perm rod-mounted hair, includes several heretofore conventional step heretofore known and practiced, the novel step(s) as herein described in the broad inventive method and preferred embodiments thereof, may be practiced by use of the foregoing inventive device illustrated in the FIGURE. The illustrated and discussed method and device each and both exclude the method-defeating use of non-ambient or non-cool (i.e. heated or hot) air to be sucked-in into the free-space in limited amounts, precluding use of heated air from any heating source such a heating elements and/or hair driers which would defeat and render inoperative the present invention. Accordingly, devoid of such "additional" negative and inoperative potential additions, the present invention as a method and as the described device affords the advantages set-forth in the objects—especially the advantage of bringing-about free-space 4 maintained by preventing the enclosure structure from collapsing against perm rod-mounted hair—which latter collapsed-state would likewise render the invention inoperative by preventing free flow of moisture and the inserted limited air equally from above and beneath the perm rod-mounted hair to result in even and through and uniform removal of moisture. Heretofore, in the absence of heat—which would defeat the present invention, there has never been utilized the vacuum of moisture from the perm rod-mounted hair. Again it is noted that the even and thorough removal of such moisture after substantially rinsing the perm lotion therefrom, avoids uneven continued and/or final processing by residual perm lotion and avoids the still otherwise existing possibility of excessive and/or hair-damaging over-processing of portions of the lotion-treated hair.

By the enclosed maintained free-space 4, vacuum can be thus applied to that space substantially surrounding the perm rod-mounted hair prior to applying the neutralizing solution after removal of the device from the head of the person receiving the perm. Likewise, by the spaced-apart small apertures 14*a*, 14*b*, 14*c* and the like and outlet ports 15 and 10*b* and 11*b* and the like, the method step of channeling flow of ambient room-temperature air to scalp-located ends of the perm rod-mounted hair is achieved, such that the channeled air is drawn past and/or through wet or moist hair mounted on the per rods, enhancing and facilitating rapid removal of water or moisture by the concurrent vacuuming of moisture from the enclosed free-space 4. Likewise, the small apertures and outlet ports for incoming ambient-temperature air, is the practice of imparting predetermined restricted flow of the ambient room-temperature air to the enclosed space relative to larger volume of flow channelled to the scalp-located ends of the hair adjacent the phantom-illustrated head 5 by the positioning of the outlet ports of the various short tubes 10 and lengthy longer tubes (to reach perm rod-mounted hair spaced further away from the sealing elastic border-band 17), thereby channeling the ambient room-temperature air concurrently to a plurality of spaced-apart locations. By virtue of the above-discussed larger (greater) cross-sectional area of flow pace and inlet and outlet ports of the longer tubes (longer in varying degrees, in some embodiments), the eventual rate of flow of a substantially common and identical amount of ambient air from the tubular spaces and their outlet ports into the free-space is substantially constant from all such tubes 10 and 11, as a method step of channeling substantially equal volumes of air to each of less and more distant locations. Clearly, by utilizing the same arrangement to remove rinsing water prior to taking down the set hair from the perm rods, involves the method step of vacuum removal of such rinsing moisture or water immediately prior to taking-down the permed-hair from the perm hair-mounting rods, as well as further using the same vacuuming device (thus devoid of heat) to efficiently and quickly method-step remove residual moisture "after" the hair has been taken-down off of the perm rods. As above-noted, the outlet-ports of the various tubes 10 and 11 make possible the channeling of air to the scalp-located ends of the hair mounted on the perm rods.

It is within the scope of the present invention to make such variations and/or modification(s) and/or substitution of equivalents to the extent that would be obvious to a person of ordinary skill in this art.

I claim:

1. A method of perming hair consisting essentially of, in combination:

applying water to hair to be permed sufficiently to obtain dampened hair; thereafter wrapping the dampened hair on perm rods; thereafter applying perm solution to the hair sufficiently to obtain perm-treated hair; thereafter water-rinsing residual perm solution from the perm-treated hair to obtain rinsed hair; thereafter employing a perm-setting device, said perm-setting device consisting essentially of a first vacuuming means for substantially enclosing and maintaining free-space surrounding substantially all of a person's upper head having perm-mounted rinsed hair rinsed substantially free from residual perm solution and for applying vacuuming to an enclosed and maintained free-space substantially surrounding all of said perm rod mounted hair of said person's upper head, said method further comprising the step of vacuuming moisture from the rinsed hair mounted on perm-rods; thereafter applying a neutralizing water-solution perm-neutralizer to obtain neutralized hair; thereafter applying sufficient rinsing water to the hair to rinse residual water-solution perm-neutralizer from the hair in its neutralized state to obtain rinsed hair; thereafter removing residual rinsing water from the rinsed hair to obtain dried hair; and taking down the set hair from the perm rods subsequent to applying said neutralizer solution, said employing of the perm-setting device including enclosing space surrounding said rinsed hair followed thereafter by vacuuming of said hair by channeling a flow of ambient, room-temperature air to scalp-located ends of said hair such that channeled air is vacuum-drawn from said scalp-located ends through wet hair mounted on the perm rods thereby enhancing and facilitating rapid removal of moisture by said vacuuming, said vacuuming consisting of channeling said ambient room-temperature air concurrently to a plurality of spaced-apart locations of perm-treated rod-mounted rinsed hair.

2. The method of claim 1 in which said channeling flow further includes imparting predetermined flow of said ambient room-temperature air to said enclosed space relative to larger volume of flow channelled to said scalp-located ends of said hair.

3. The method of claim 2, in which said channeling of flow of ambient room-temperature air to said scalp-located ends of said hair includes separately channeling said ambient room-temperature air concurrently to a plurality of spaced-apart locations.

4. The method of claim 3, in which said channeling of said ambient room-temperature air to said plurality includes said channeling when being for greater distances to some of said plurality, said channeling at said greater distances being of greater volume flow such that volume of channeled air reaching more distant ones of said plurality is substantially equal to volume of air reaching less distant ones of said plurality whereby channeled air reaching all of said plurality is substantially constant in volume.

5. The method of claim 4, in which said applying of water to hair to be permed includes shampooing the hair.

6. The method of claim 1, in which said vacuuming of said hair includes channeling of predetermined restricted flow of said ambient room-temperature air to said enclosed space relative to larger volume of flow channelled to said scalp-located ends of said hair.

7. The method of claim 1, in which said vacuuming of said hair includes, when being for greater channeling distances to some of said plurality, said channeling at said greater distances being of greater volume flow such that volume of channeled air reaching more distant ones of said plurality is substantially equal to volume of air reaching less distant ones of said plurality whereby channeled air reaching all of said plurality is substantially constant in volume.

8. The method of claim 1, of which said applying of water to hair to be permed, includes shampooing the hair.

9. A perm-setting device consisting essentially of a first vacuuming means for substantially enclosing and maintaing free-space surrounding substantially all of a person's upper head having perm-mounted rinsed hair rinsed substantially free from residual perm solution and for applying vacuuming to enclosed and maintained free-space substantially surrounding all of said perm rod-mounted hair of said person's upper head.

10. The perm-setting device of claim 9, including a second vacuuming means for channeling of predetermined restricted flow of said ambient room-temperature air to said enclosed space to said enclosed space relative to larger volume of flow channelled to said scalp-located ends of said hair.

11. The perm-setting device of claim 10, including a third vacuuming means for separately channeling ambient room-temperature air concurrently to a plurality of spaced-apart location.

12. The perm-setting device of claim 11, including a fourth vacuuming means for channeling ambient room-temperature air for greater distances to some of said plurality, said channeling at said greater distances providing for greater volume flow such that volume of channeled air reaching more distant ones of said plurality is syubstantially equal to volume of air reaching less distant ones of said plurality whereby channeled air reaching all of said plurality is substantially constant in volume.

13. The perm-setting device of claim 9, including a second vacuuming means for separately channeling ambient room-temperature air concurrently to a plurality of spaced-apart locations.

14. The perm-setting device of claim 13, including a third vacuuming means for channeling ambient room-temperature air for greater distances to some of said plurality as compared to remaining others of said plurality, said channeling at said greater distances providing for greater volume flow such that volume of channeled air reaching more distant ones of said plurality is substantially equal to volume of air reaching less distant ones of said plurality whereby channeled air reaching all of said plurality is substantially constant in volume.

15. The perm-setting device of claim 9, in which said enclosing means includes a substantially hemispherically-shaped dome means for substantially sealing and maintaining said free-space, and additionally includes at-least one spacer-structure mounted on and extending downwardly and radially-inwardly to at-least one position at which support contact will be made with the head or perm rod-mounted hair whereby maintaining the free-space is facilitated.

16. A device for vacuuming moisture from hair following rinsing perm-solution from a person's hair, consisting essentially of, in combination: an enclosure structure of a shape and size to substantially enclose an upper hair-portion of the top of a person's head and for providing enclosed free-space above and surrounding perm rod-mounted hair of a person when mounted on the person's head, an enclosure support structure providing support of said enclosure structure sufficiently to maintain said free-space when said enclosure structure is worn on the person's head, and vaccuming means for establishing and maintaining at-least a partial vacuum within said free-space when said enclosure structure is mounted on a person's head.

17. The device of claim 16, including air-channeling means for channeling ambient-temperature air to said free-space.

18. The device of claim 17, in which said air-channelling means includes small apertures of predetermined sizes sufficiently small as to maintain at-least a partial vacuum within said free-space when said enclosure structure is mounted on a person's head.

19. The device of claim 18, in which said air-channelling means includes tubular structures having opposite open ends in communication with flow space within said tubular structures, at-least some of said tubular structures being of sufficient length as to have one end positioned adjacent hair follicles of perm rod-mounted hair while a remaining other open end is positioned to receive ambient temperature air exterior to said free-space, and at-least some of remaining ones of said tubular structures being of lengths adapted for receiving and channeling ambient temperautre air to said free-space from air-containing space exterior to said free-space.

20. The device of claim 9, in which each of said tubular structures have cross-sectional areas of said flow spaces thereof, some of said tubular structures with cross-sectional area of flow spaces extending along a length of said flow space at a magnitude greater than cross-sectional area of flow spaces of remaining ones of said tubular structures, such that exiting quantities of air drawn into said free-space from said some and said remaining ones of said tubular structures is substantially equal in volume per tubular structure.

* * * * *